US007559212B2

(12) United States Patent
Bergander

(10) Patent No.: US 7,559,212 B2
(45) Date of Patent: Jul. 14, 2009

(54) REFRIGERANT PRESSURIZATION SYSTEM WITH A TWO-PHASE CONDENSING EJECTOR

(76) Inventor: Mark Bergander, 68 Winterhill Rd., Madison, CT (US) 06443

( * ) Notice: Subject to any disclaimer, the term of this patent is extended or adjusted under 35 U.S.C. 154(b) by 199 days.

(21) Appl. No.: 11/588,622

(22) Filed: Oct. 27, 2006

(65) Prior Publication Data

US 2007/0101760 A1 May 10, 2007

Related U.S. Application Data

(60) Provisional application No. 60/734,112, filed on Nov. 8, 2005.

(51) Int. Cl.
*F25B 1/06* (2006.01)

(52) U.S. Cl. ..... 62/500

(58) Field of Classification Search ..... 62/500, 62/191

See application file for complete search history.

(56) References Cited

U.S. PATENT DOCUMENTS 3,670,519 A * 6/1972 Newton ..... 62/116
3,701,264 A * 10/1972 Newton ..... 62/191
5,205,648 A 4/1993 Fissenko
5,275,486 A 1/1994 Fissenko
5,338,113 A 8/1994 Fissenko
5,343,711 A * 9/1994 Kornhauser et al. ..... 62/116

FOREIGN PATENT DOCUMENTS

RU 2016261 C1 7/1994

OTHER PUBLICATIONS

Van Wijngaarden,L. One-Dimensional Flow of Liquids Containing Small Gas Bubbles, Annual Fluid Mechanics, 1972, vol. 4, pp. 369-396, Enschede, The Netherlands.
Wallis, Graham B., Critical Two-Phase Flow, Int. J. Multiphase Flow, 1980, vol. 6, pp. 97-112, New Hampshire.
Levy, E., et al., Liquid Vapor Interactions in a Constant-Area Condensing Ejector, Journal of Basic Engineering, Mar. 1972, pp. 169-180, Pennsylvania.
Zhao, J.F., Investigation of the Compressibility of Extra-High Velocity Aerated Flow, Journal of Hydraulic Research, vol. 38, 2000, No. 5, pp. 351-357, Netherlands.
Downar-Zapolski P., et al., The Non-Equilibrium Relaxation Model for One-Dimensional Flashing Liquid Flow, Int. J. Multiphase Flow, vol. 22, No. 3, 1996, pp. 473-483, New York.

(Continued)

*Primary Examiner*—Melvin Jones
(74) *Attorney, Agent, or Firm*—Michaud Duffy Group LLP

(57) ABSTRACT

A refrigerant pressurization system including an ejector having a first conduit for flowing a liquid refrigerant therethrough and a nozzle for accelerating a vapor refrigerant therethrough. The first conduit is positioned such that the liquid refrigerant is discharged from the first conduit into the nozzle. The ejector includes a mixing chamber for condensing the vapor refrigerant. The mixing chamber comprises at least a portion of the nozzle and transitions into a second conduit having a substantially constant cross sectional area. The condensation of the vapor refrigerant in the mixing chamber causes the refrigerant mixture in at least a portion of the mixing chamber to be at a pressure greater than that of the refrigerant entering the nozzle and greater than that entering the first conduit.

11 Claims, 5 Drawing Sheets

OTHER PUBLICATIONS

Daqing, L. et al., Transcritical Co2 Refriferation Cycle with . . . , International Refrigeration and Air Conditioning Conference, Jul. 12-15, 2004 No. R153, Indiana.

Elbel, S.W., et al. Effect of Internal Heat Exchanger on Performance of Transcritical CO2 Systems . . . , International Refrigeration and Air Conditioning Conference, Purdue, 2004.

Miguel, J., et al., An Analytical and Experimental Investigation of a Condensing Ejector with a Condensable . . . , 1st AIAA Annual Meeting, Jun. 29-Jul. 2, 1964, Washington D.C.

Brennen, C., Chapter 6, Homogeneous Bubbly Flows, Cavitation and Bubble Dynamics, Oxford University. Press, 1995, pp. 1-39, New York.

Bergander, Mark J., Information Bridge (2 pages), New Regenerative Cycle for Vapor Compression Refrigeration, Magnetic Development, Aug. 29, 2005, pp. 1-31, United States.

Tchesskii, Yu., et al., Upon a Certain method of Definition Volumetric Quantitative Gas in Double-Phase Flow of Liquid and Gas, Odessa Hydrometeorological Institute, Ukraine.

Fisenko, V., The Fisonic Energy Device Physical Principals, Joint Power Conference, "Vapor Compression Refrigeration Installations" Oct. 11, 1995, Minneapolis.

Bohdal, T., et al., Vapor Compression Refrigeration Installations, (book in Polish), WNT, Warsaw, 2003.

Fisenko, V.V.,S'zhimayemost Teplonosityela . . . ,"Compressibility of heat carrying mediums and efficiency of thermodynamic cycles in nuclear power stations", 1987,Moscow.

Hays L., Brasz J.J., A Transcritical CO2 Turbine-Compressor, International Refrigeration and Air Conditioning Conference at Purdue, Jul. 12-15, 2004, Paper No. C137, pp. 1-7,IN.

New Developments in thermodynamics of two-phase flow theoretical background and practical solutions, http://www.fisonic.com/term.htm.

* cited by examiner

REFRIGERANT PRESSURIZATION SYSTEM WITH A TWO-PHASE CONDENSING EJECTOR

This application claims priority from provisional application Ser. No. 60/734,112, filed Nov. 8, 2005, the disclosure of which is incorporated by reference herein in its entirety.

The U.S. Government has a paid-up license in this invention and the right in limited circumstances to require the patent owner to license others on reasonable terms as provided for by the terms of Grant No. DE-FG36-04GO14327 awarded by the U.S. Department of Energy.

FIELD OF THE INVENTION

The present invention is generally directed to a refrigerant pressurization system and a method of operating the same; and is more specifically directed to a refrigerant pressurization system comprising a two-phase condensing ejector.

BACKGROUND OF THE INVENTION

Vapor compression cycles are used in refrigeration, space cooling and space heating applications. Typical vapor compression cycles involve compressing and decompressing a refrigerant in a closed loop system and circulating the refrigerant through an evaporator and a condenser. The refrigerant serves to absorb thermal energy in the form of heat from the evaporator and transport the thermal energy to the condenser where it can be released. In refrigeration and cooling applications heat is absorbed from a space by the refrigerant during an evaporation portion of the cycle where the refrigerant changes into a vapor phase. The absorption of heat provides useful cooling of the space. The vapor is subsequently compressed in a compressor. Energy is consumed by the compressor during the compression of the vapor. Compression of the vapor facilitates condensation of the vapor into a liquid. Condensation of the vapor is caused by flowing the compressed vapor through a condenser where heat is released into a heat sink thereby condensing the refrigerant into a liquid. The liquid is circulated through the closed loop to a decompression device, typically an expansion valve, where the pressure of the refrigerant is decreased. Typically, the refrigerant pressure is reduced by a factor of five or more. The decompressed refrigerant is returned to the evaporator resuming the cycle. Although decompression of the refrigerant is desirable to bring the pressure of the refrigerant to within a desired operating range prior to entering the evaporator, kinetic energy losses are experienced across the expansion valve. This kinetic energy loss is typically not recovered and therefore energy input is required for compressing the vapor in the compressor.

In an effort to improve the efficiency of vapor compression cycles, it is desirable to recover the kinetic energy lost during decompression of the refrigerant across the expansion valve. Venturi nozzles have been used to help recover some of the kinetic energy associated with decompression of the refrigerant. Typically, venturi nozzles are comprised of a fluid conduit having an inlet, an outlet and throat disposed therebetween. The flow area of the throat is less than that of the inlet and the outlet. The velocity of the fluid flowing in the throat is greater than the velocity of the fluid flowing at the inlet and the outlet. As a result of conservation of momentum the pressure at the throat is less than the pressure at the inlet and the outlet. A fluid port is generally connected to the throat to entrain fluid therethrough. The pressure at the outlet of venturi nozzles is an intermediate pressure between the pressure at the venturi inlet and the pressure at the fluid port connected to the throat.

Efficiency of a refrigeration system can be increased with the use of a venturi. The fluid port at the throat of the venturi is connected to an outlet of the evaporator and the venturi inlet is connected to an outlet of the condenser. A liquid-vapor mixture of refrigerant is thus produced at the outlet of the venturi at an intermediate pressure between the pressure at the venturi inlet and that at the throat of the venturi. After the liquid-vapor mixture exits the venturi, liquid and vapor phases are separated. The liquid refrigerant is decompressed through an expansion valve which discharges into the evaporator; and vapor is supplied to the compressor suction at the intermediate pressure. Therefore, the compressor requires less energy input to achieve a desired compression and the refrigeration system efficiency is increased. However, because the venturi recovers only a portion of the kinetic energy and losses through the expansion valve are not recovered, further system efficiency improvements are needed.

Referring to FIG. 1, during operation of a prior art refrigeration cycle 60, the refrigerant absorbs energy from an evaporator which increases the enthalpy of the refrigerant between points 61 and 62. A compressor provides the entire pressurization from between points 62 and 63. A condenser provides a heat sink for removing energy from the refrigerant thereby reducing the enthalpy of the liquid refrigerant between points 63 and 66, at a substantially constant pressure. Liquid refrigerant exiting the condenser is decompressed by throttling through a decompression device thereby reducing the pressure of the refrigerant between points 66 and 61.

There is a need to provide a refrigeration cycle with a more efficient refrigerant pressurization system. Prior art methods and systems for addressing these needs were too inefficient or ineffective or a combination of these. Based on the foregoing, it is the general object of the present invention to improve upon or overcome the problems and drawbacks of the prior art.

SUMMARY OF THE INVENTION

According to one aspect of the present invention, a pressurization system includes an ejector having a first conduit for flowing a liquid refrigerant therethrough and a first nozzle for flowing a vapor refrigerant and accelerating at least a refrigerant mixture therethrough. The first conduit is positioned such that the liquid refrigerant is discharged from the first conduit into the first nozzle. The ejector includes a mixing chamber for condensing the vapor refrigerant. The mixing chamber comprises at least a portion of the first nozzle and transitions into a second conduit having a substantially constant cross sectional area. The condensation of the vapor refrigerant in the mixing chamber causes the refrigerant mixture in at least a portion of the second conduit to be at a pressure greater than that of the refrigerant entering the first nozzle and greater than that entering the first conduit.

In another aspect of the present invention, a method for operating a refrigerant pressurization system comprises the steps of providing a vapor refrigerant; a liquid refrigerant; a compressor having a discharge; and an ejector having a first nozzle and a first conduit. The first conduit is in fluid communication with the discharge and is positioned such that the liquid refrigerant is ejected into the first nozzle. The ejector includes a mixing chamber comprising at least a portion of the first nozzle and transitions into a second conduit having a substantially constant cross sectional area. A pump in fluid communication with the first conduit is also provided.

The method of operation includes the steps of pressurizing the liquid refrigerant with the pump to a first pressure and flowing the liquid refrigerant through the first conduit. The vapor refrigerant is compressed with the compressor to a second pressure. The vapor refrigerant is supplied to the first nozzle. The liquid refrigerant is ejected from the first conduit into a stream of vapor refrigerant flowing through the first nozzle and into the mixing chamber thereby defining a refrigerant mixture. The refrigerant mixture is flowed through the first nozzle and into the second conduit. The vapor refrigerant is condensed thereby causing the refrigerant mixture pressure to increase above the first pressure and the second pressure.

During operation of the ejector, compressed vapor refrigerant is provided from the compressor to the first nozzle. A liquid refrigerant is flowed through the first conduit. The liquid refrigerant is discharged into the mixing chamber with the vapor refrigerant resulting in a two phase mixture of refrigerant. The mixing of the vapor and liquid refrigerant, leads to the condensation of the vapor refrigerant thus pressurizing the two phase refrigerant mixture.

DETAILED DESCRIPTION OF THE PREFERRED EMBODIMENT

Figure 1:
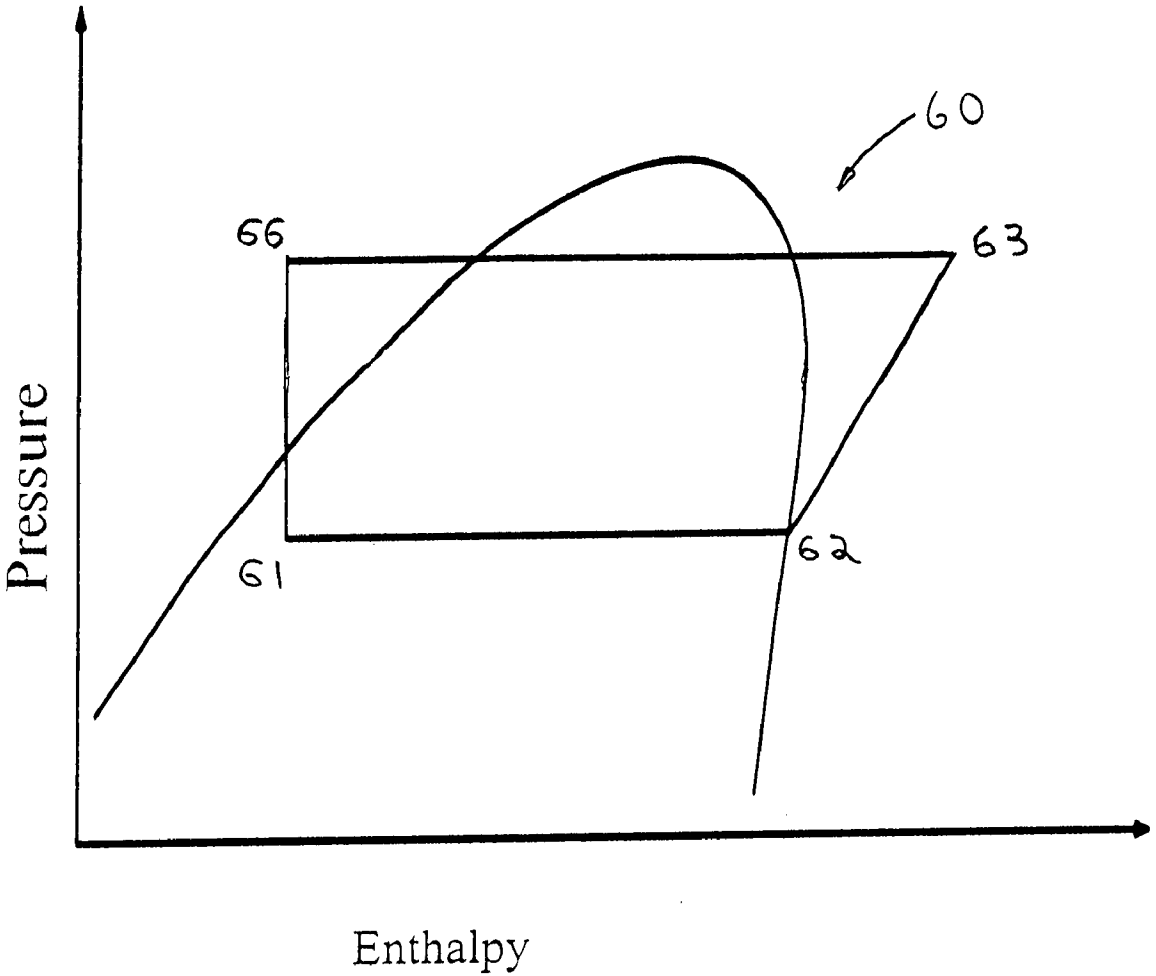
FIG. 1 Prior Art
FIG. 1 is a pressure-enthalpy schematic of a refrigeration cycle of the prior art.
Figure 2:
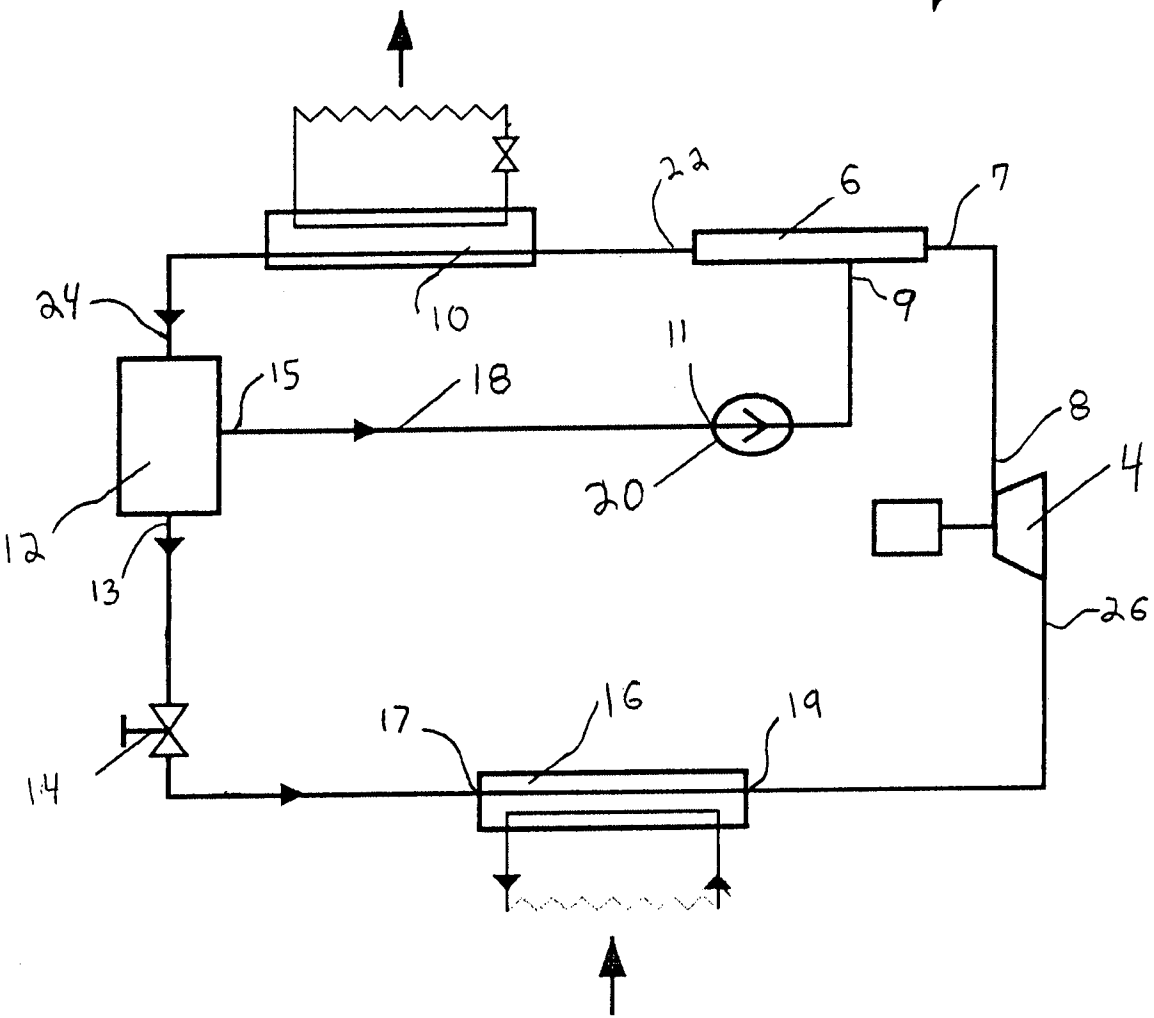
FIG. 2 is a schematic diagram of a refrigerant pressurization system.

Referring to FIG. 2, a refrigerant pressurization system is shown generally at 2. The refrigerant pressurization system 2 is a closed loop system which includes a compressor 4 and an ejector 6 having a vapor inlet 7 in fluid communication with a discharge 8 of the compressor for compressing a refrigerant in two stages. Preferably, the compressor 4 performs a first stage of compression by pressurizing the refrigerant to 50-60% of a required system operating pressure. In a second stage of compression, the ejector 6 increases refrigerant pressure up to the required system operating pressure. Reducing the pressurization requirement of the compressor 4 reduces the energy requirement to operate the compressor thereby increasing operating efficiency of the refrigerant pressurization system 2.

The refrigerant pressurization system 2 also includes a first heat exchanger 10, a separator 12, a device 14 for decompressing refrigerant, and a second heat exchanger 16. The first heat exchanger 10 is coupled between and is in fluid communication with a liquid outlet 22 of the ejector 6 and an inlet 24 of the separator 12. The device 14 for decompressing refrigerant is coupled between a first outlet 13 of the separator 12 and an inlet 17 of the second heat exchanger 16. Preferably, the device 14 for decompressing refrigerant is an expansion valve. The compressor 4 includes a compressor suction 26 in fluid communication with another side 19 of the second heat exchanger 16. The compressor 4, the ejector 6, the first heat exchanger 10, the separator 12, the device 14 for decompressing the refrigerant, and the second heat exchanger 16 cooperate to define the closed loop refrigerant system wherein the refrigerant is cyclically compressed, condensed, cooled, decompressed, heated, and vaporized. The refrigerant pressurization system 2 further includes a pump 20 having a suction port 11, the pump is positioned in a recirculation path 18 between a second outlet 15 of the separator 12 and a liquid inlet 9 of the ejector 6. The pump 20 increases the pressure of a portion of the liquid refrigerant exiting the first heat exchanger 10 to compensate for pressure losses at least between the first heat exchanger and the separator 12 and for supplying liquid refrigerant to the ejector 6. Preferably the pump increases the static pressure of the liquid refrigerant to a pressure less than the static pressure at the liquid outlet 22 of the ejector. The pump 20 compensates for energy losses in the ejector 6 associated with the conversion of kinetic energy into potential energy as the ejector increases refrigerant pressure up to the required system operating pressure. While the pump is described as increasing the static pressure of the liquid refrigerant to a pressure less than the static pressure at the liquid outlet 22 of the ejector 6, the present invention is not limited in this regard as refrigerant pressurization systems having a pump for increasing the static pressure of the liquid refrigerant to other pressures including but not limited to a pressure greater than or equal to the static pressure at the liquid outlet 22 of the ejector 6 are also within the scope of the present invention.

Refrigerants suitable for use in the refrigerant pressurization system 2 are fluids having relatively low boiling points and high heats of vaporization including but limited to halomethanes R12, R22, R134*a* and mixtures thereof comprising mineral oil, synthetic oil and water.

Referring to FIG. 2, the first and second heat exchangers 10, 16 are preferably air cooled type heat exchangers wherein the refrigerant flows through tubes therein. For cooling and refrigeration, the first heat exchanger 10 is a condenser for cooling the refrigerant flowing therethrough and transferring thermal energy to a heat sink; and the second heat exchanger 16 is an evaporator for heating the refrigerant by absorption of thermal energy from a heat source. For heating, the first heat exchanger 10 is a condenser for cooling the refrigerant flowing therethrough and transferring thermal energy to a space to be heated; and the second heat exchanger 16 is an evaporator for heating the refrigerant by absorption of thermal energy from a heat sink. The first and second heat exchangers 10, 16 remove and add heat to the refrigerant, respectively, thereby establishing an operating pressure range of the refrigerant pressurization system 2. While an air cooled heat exchanger is described, the present invention is not limited in this regard as other types of heat exchangers can also be used including but not limited to shell and tube, tube-in-tube and direct conduction heat exchangers.

Referring to FIG. 2 the separator 12 is preferably a cyclone type separator for separating vapor from the refrigerant entering the inlet 24 so that the refrigerant exiting the second outlet 15 is essentially all liquid. The cyclone separator includes a substantially cylindrical vessel and another vessel having a tapered cross section coupled to an upwardly extending end thereof. A two phase mixture of vapor and liquid refrigerant is supplied to the vessel having a tapered cross section. Liquid refrigerant is withdrawn from a bottom portion of the cylindrical vessel and any remaining two phase mixture can be withdrawn from a top end of the vessel having a tapered cross section. While a cyclone separator has been described, the present invention is not limited in this regard as other types of separators can be used including but not limited to separators having internal baffles and those having no internal baffles.

Figure 3:
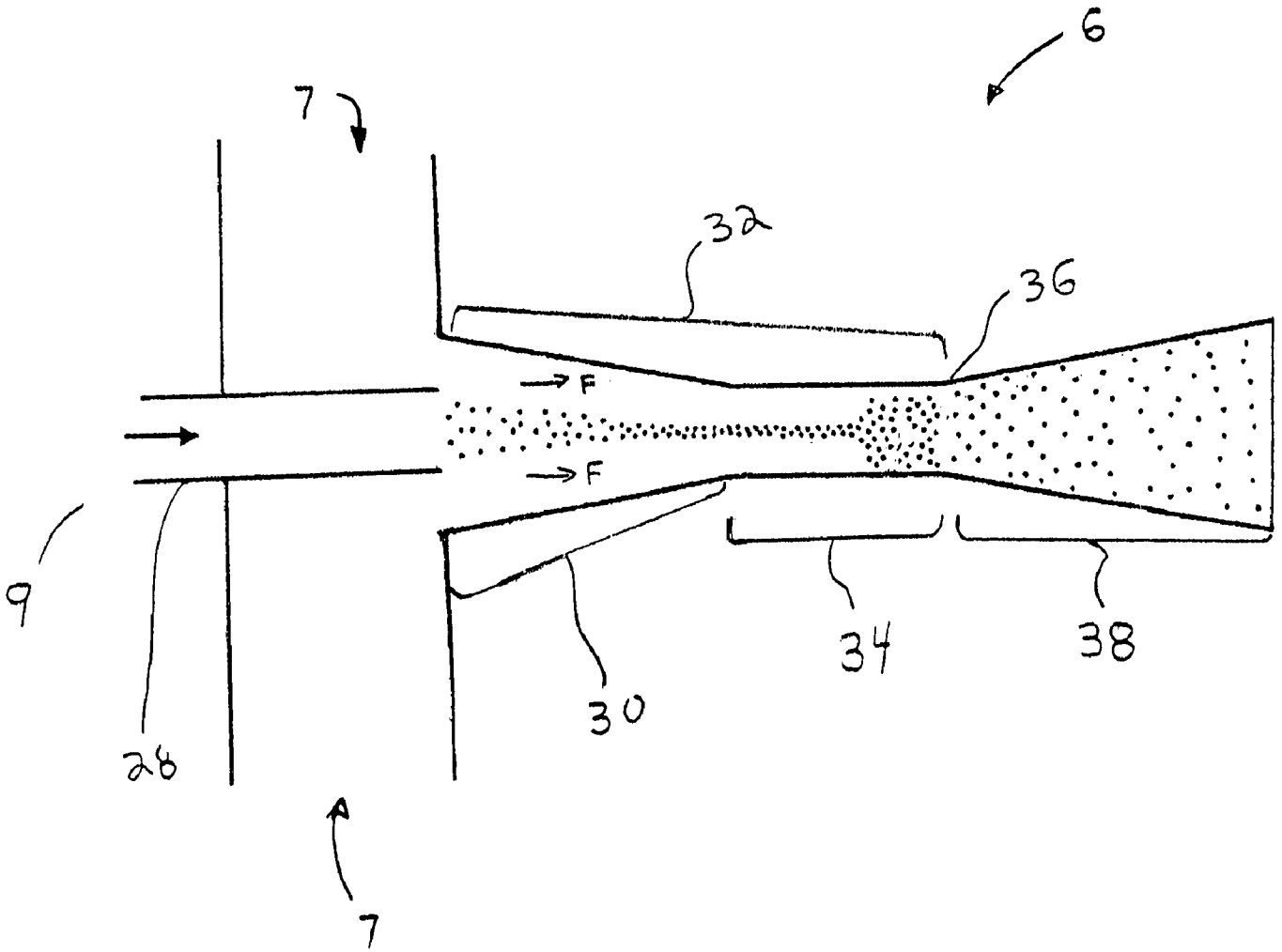
FIG. 3 is a schematic view of a two-phase condensing ejector.

Referring to FIG. 3, the ejector shown generally at 6 is a condensing ejector for condensing vapor refrigerant supplied thereto. The ejector 6 is shown having a first conduit 28 in fluid communication with the liquid inlet 9 for flowing the liquid refrigerant therethrough. The vapor inlet 7 is in fluid communication with a first nozzle 30. The first nozzle 30 has a cross sectional flow area which tapers in the direction of flow, generally designated by arrows F. The mass flow rate of refrigerant is substantially constant through the nozzle 30 resulting in the acceleration of the refrigerant therethrough. The ejector 6 is not limited to that shown in FIGS. 2 and 3, however, as other configurations are within the scope of the present invention, including but not limited to an ejector having liquid refrigerant being supplied to the ejector through the vapor inlet 7 and vapor refrigerant being supplied through the liquid inlet 9.

Referring to FIG. 3, the first conduit 28 is positioned such that the liquid refrigerant is discharged into the first nozzle 30. The ejector 6 includes a mixing chamber 32 for condensing the vapor refrigerant. The mixing chamber 32 includes at least a portion of the first nozzle 30 and transitions into a second conduit 34 having a substantially constant cross sectional area. The vapor refrigerant and the liquid refrigerant mix in the mixing chamber 32 to produce a refrigerant mixture. The refrigerant mixture is defined by the percent volume occupied by vapor refrigerant $\beta_V$ in a unit volume of the refrigerant mixture as shown in Equation 1 (Eq. 1).

$$\beta_V=100\ (V_V/(V_V+V_L)) \qquad \text{(Eq. 1)}$$

Where:

$V_V$=unit volume of vapor refrigerant $V_L$=unit volume of liquid refrigerant

The discharge of the liquid refrigerant into the first nozzle 30 causes a rapid condensation of the vapor refrigerant and the formation of refrigerant mixture within the mixing chamber 32. The percent volume occupied by vapor refrigerant $\beta_V$ decreases as the refrigerant mixture flows through the mixing chamber 32 in the general direction of the flow arrows F. The refrigerant mixture becomes essentially all liquid in at least a portion of the second conduit 34. Preferably, the refrigerant becomes essentially all liquid at a terminal end 36 of the second conduit 34. The progressive reduction in cross sectional area of the first nozzle 30 in the general direction of the flow arrows F and the condensation of the vapor refrigerant causes the static pressure of the refrigerant mixture to increase as the refrigerant mixture flows through the first nozzle 30. Condensation of the vapor refrigerant in the second conduit 34 causes the static pressure of the refrigerant mixture to increase above the static pressure of the liquid refrigerant entering the first conduit 28 and above the static pressure of the vapor refrigerant entering the first nozzle 30.

The mixing chamber 32 also includes a diffuser 38 mounted on the terminal end 36 of the second conduit 34 for increasing the static pressure of the refrigerant mixture above the static pressure of the liquid refrigerant entering the first conduit 28 and above the static pressure of the vapor refrigerant entering the first nozzle 30.

The speed at which sound travels in the liquid refrigerant is greater than the speed at which sound travels in the vapor refrigerant; and the speed at which sound travels in the refrigerant mixture is less than the speed at which sound travels in the vapor refrigerant. The speed at which sound travels in the refrigerant mixture reaches a minimum when $\beta_V$ is approximately 0.5. In another embodiment of the present invention, the refrigerant mixture is accelerated in at least a portion of the mixing chamber. The velocity of the refrigerant mixture flowing in the mixing chamber, preferably at a cross section adjacent to the terminal end 36 of the second conduit 34, exceeds the speed at which sound travels therein resulting in a pressure shock which causes the static pressure of the refrigerant mixture to increase above the static pressure of the liquid refrigerant entering the first conduit 28 and above the static pressure of the vapor refrigerant entering the first nozzle 30. In another embodiment, the pressure shock occurs in the diffuser 38.

Figure 4:
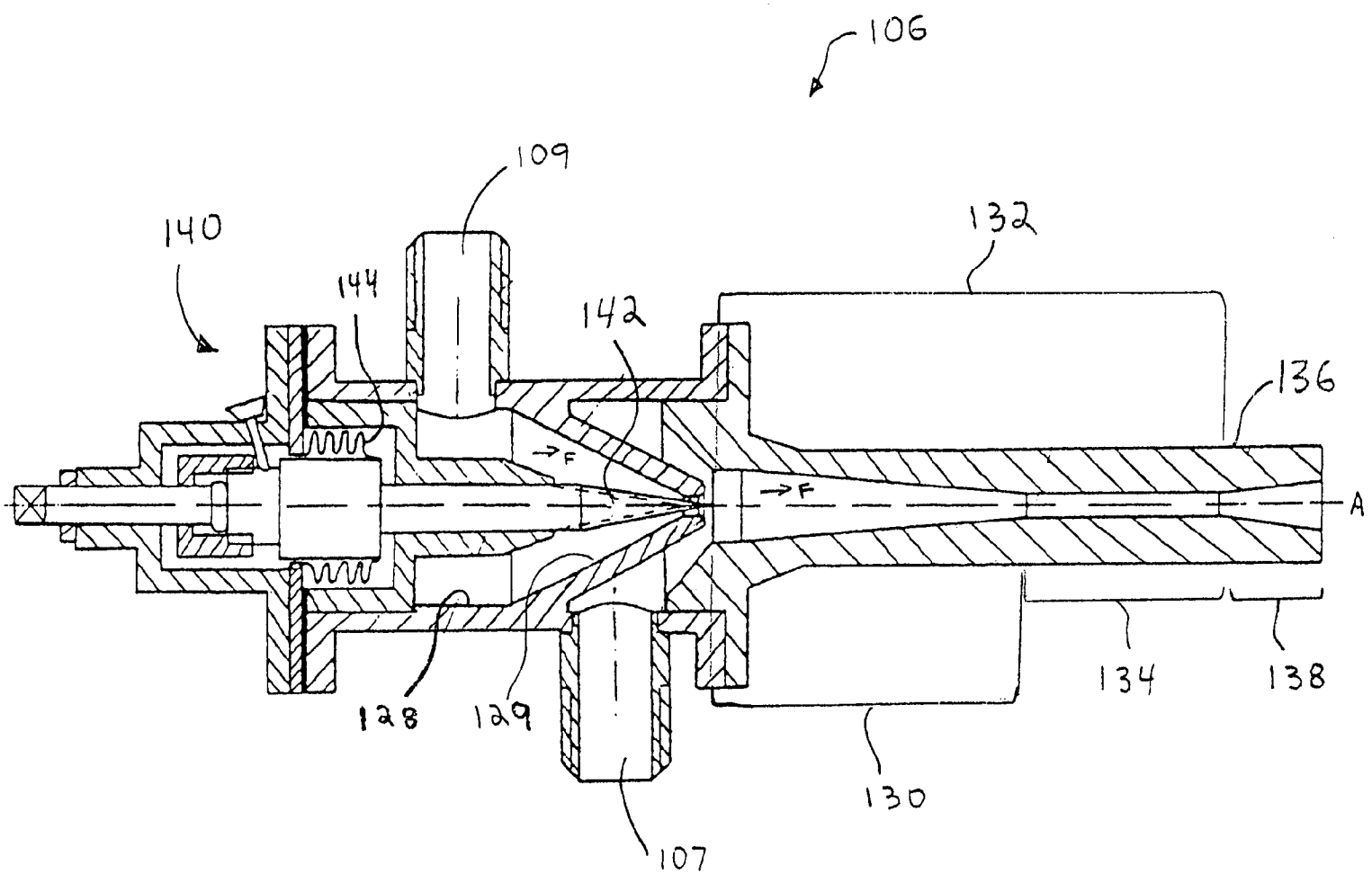
FIG. 4 is a schematic view of a two-phase condensing ejector having a flow control device.

Referring to FIG. 4, another exemplary embodiment of the ejector shown generally at 106 is a condensing ejector for condensing vapor refrigerant supplied thereto. The ejector 106 is suitable for use in a closed loop refrigerant pressurization system similar to that illustrated above in FIG. 2. The ejector 106 includes a control valve assembly 140 coupled thereto. The ejector 106 is shown having a first conduit 128 and a second nozzle 129 extending therefrom. The second nozzle 129 is in fluid communication with the liquid inlet 109 and the first conduit 128. The second nozzle 129 can accelerate the liquid refrigerant therethrough. The valve assembly includes a valve plug 142 which projects into the second nozzle 129 for controlling flow of liquid refrigerant therethrough. The valve plug 142 is positioned within the first nozzle by a valve actuator. The control valve assembly 140 includes a sealing device, preferably a bellows seal 144 for preventing leakage of refrigerant from the ejector 106. The ejector 106 also includes a first nozzle 30 in fluid communication with the vapor inlet 107 for accelerating at least one of the vapor refrigerant and a refrigerant mixture therethrough. In addition, the nozzles 129, 130 have cross sectional flow areas which taper in the direction of flow, generally designated by arrows F.

Referring to FIG. 4, the second nozzle 129 is positioned such that the liquid refrigerant is discharged from the second nozzle into the first nozzle 130 and the vapor refrigerant flowing therethrough. Preferably, the first and second nozzles 129, 130 are concentrically positioned about axis A. The ejector 106 includes a mixing chamber 132 for condensing the vapor refrigerant and flowing the refrigerant mixture therethrough. The mixing chamber 132 includes at least a portion of the first nozzle 129 and transitions into a conduit 134 having a substantially constant cross sectional area.

The discharge of the liquid refrigerant into the first nozzle 130 causes a rapid condensation of the vapor refrigerant and the formation of refrigerant mixture within the mixing chamber 132. The percent volume occupied by vapor refrigerant $\beta_V$ decreases as the refrigerant mixture flows through the mixing chamber 132 in the general direction of the flow arrows F. The refrigerant mixture becomes essentially all liquid in at least a portion of the second conduit 134. Preferably, the refrigerant becomes essentially all liquid at a terminal end 136 of the second conduit 134. The reduction in cross sectional area of the first nozzle 130 and the condensation of the vapor refrigerant causes the static pressure of the refrigerant mixture to increase as the refrigerant mixture flows through the first nozzle 130. Condensation of the vapor refrigerant in the second conduit 134 causes the static pressure of the refrigerant mixture to increase above the static pressure of the liquid refrigerant entering the second nozzle 129 and above the static pressure of the vapor refrigerant entering the first nozzle 130.

The mixing chamber 132 also includes a diffuser 138 mounted on the terminal end 136 of the second conduit 134 for increasing the static pressure of the refrigerant mixture above the static pressure of the liquid refrigerant entering the second nozzle 129 and above the static pressure of the vapor refrigerant entering the first nozzle 130.

In another embodiment of the present invention, in at least a portion of the mixing chamber 132, preferably adjacent to the terminal end 136 of the second conduit 134, the velocity of the refrigerant mixture exceeds the speed at which sound travels therein resulting in a pressure shock which causes the static pressure of the refrigerant mixture to increase above the static pressure of the liquid refrigerant entering the second nozzle 129 and above the static pressure of the vapor refrigerant entering the first nozzle 130. In another embodiment, the pressure shock occurs in the diffuser 138.

Although the ejector 106 is shown having the control valve assembly 140 for controlling flow of liquid refrigerant through the second nozzle 129, the present invention is not limited in this regard as other devices for controlling the flow of liquid refrigerant are also within the scope of the present invention including, but not limited to valves separate from the ejector and liquid pumps with variable speed drives.

Figure 5:
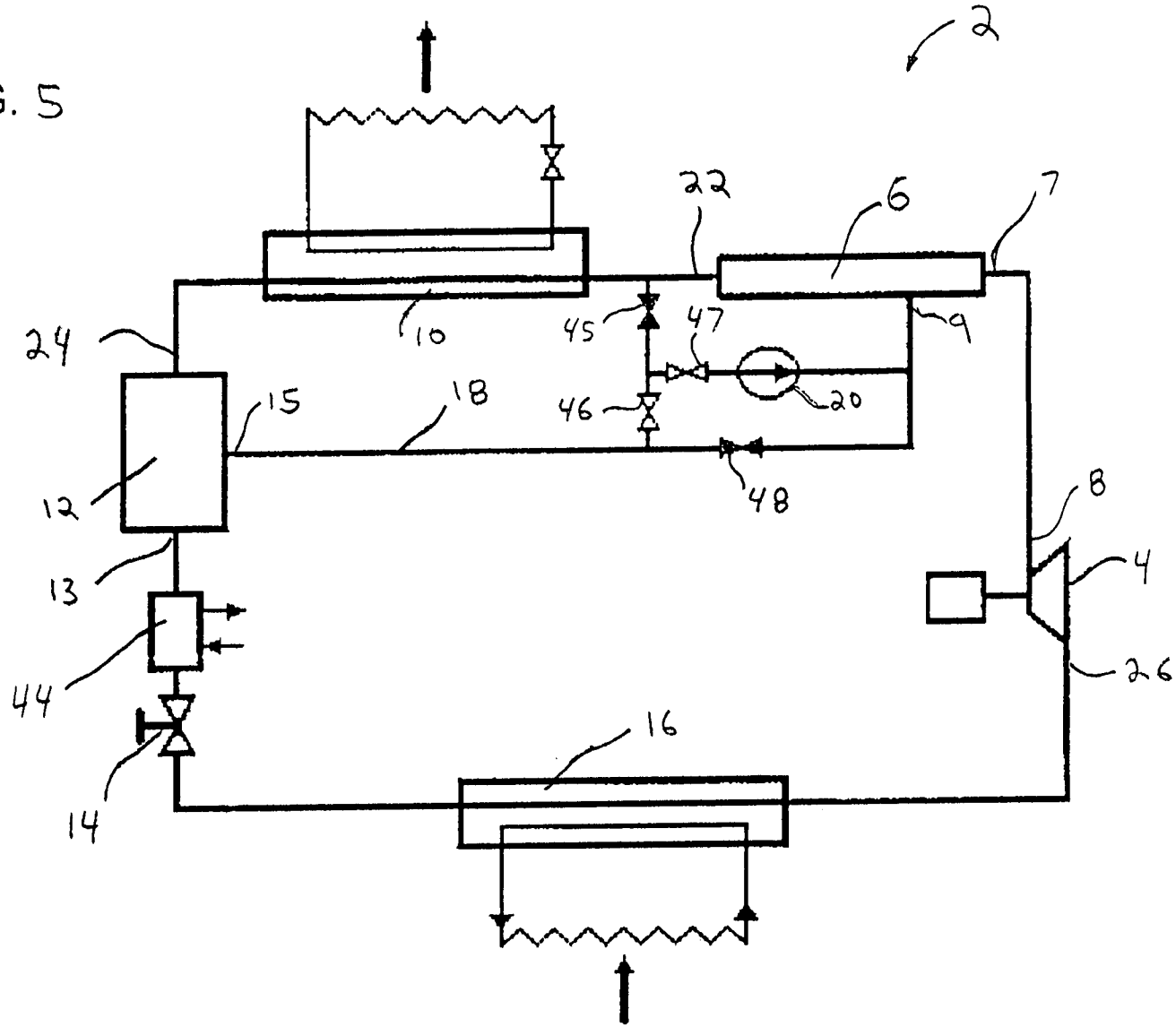
FIG. 5 is a schematic view of the refrigerant pressurization system of FIG. 1 including an intermediate heat exchanger and pump bypass valves.

Referring to FIG. 5, the refrigerant pressurization system 2 is illustrated with an intermediate heat exchanger 44 disposed between the first outlet 13 of the separator 12 and the expansion valve 14 for cooling the refrigerant prior to entering the expansion valve. Energy removed from the refrigerant and the intermediate heat exchanger 44 can be used for pre-heating of the vapor phase downstream of the second heat exchanger 16 prior to entering the compressor 4.

Referring to FIG. 5, the refrigerant pressurization system 2 includes valves 45, 46, 47 and 48 disposed in the recirculation path 18. In the present embodiment, the valves 45, 48 are shown in a closed position and the valves 46, 47 are shown in an open position to establish a flow path between the second outlet 15 of the separator 12 and a liquid inlet 9 of the ejector 6. Other configurations of the valves 45, 46, 47 and 48 are also within the scope of the present invention including but not limited to closing valves 45, 46, and 47 and opening valve 48 thereby bypassing the pump 20; opening valves 45, 46 and closing valves 47 and 48 establishing a flow path between the second outlet 15 and the liquid outlet 22 and partially opening valves 45, 46, 47 or 48 or a combination thereof.

Referring to FIGS. 2 and 3, the present invention includes a method for operating a refrigerant pressurization system 2 comprising the steps of providing a vapor refrigerant, a liquid refrigerant, a compressor 4 having a discharge 8, an ejector 6 having a first conduit 28 and a first nozzle 30. The first conduit 28 is in fluid communication with the discharge 8 and is positioned such that the liquid refrigerant is discharged into the first nozzle 30. The ejector 6 includes a mixing chamber 32 comprising at least a portion of the first nozzle 30 and transitioning into a second conduit 34 having a substantially constant cross sectional area. A pump 20, in fluid communication with the liquid refrigerant and the first conduit 28 is also provided.

The method for operating a refrigerant pressurization system 2 also includes the steps of pressurizing the liquid refrigerant with the pump 20 to a first pressure and flowing the liquid refrigerant through the first conduit 28. The vapor refrigerant is compressed with the compressor to a second pressure and the vapor refrigerant is supplied to the first nozzle 30. The liquid refrigerant is ejected from the first conduit 28 into a stream of vapor refrigerant flowing though the first nozzle 30 and into the mixing chamber 32 thereby defining a refrigerant mixture. The refrigerant mixture flows through the first nozzle 30 and into the second conduit 34. At least a portion of the vapor refrigerant is condensed in the mixing chamber 32 thereby causing pressure of the refrigerant mixture to increase above the first pressure and the second pressure.

Referring to FIGS. 2-4, the present invention includes a method for operating a refrigerant pressurization system further including the steps of providing an ejector having a control valve assembly 140 for controlling the flow of liquid refrigerant coupled to the ejector 8 and a second nozzle 129 extending from the first conduit 128. At least a portion of the control valve assembly 140 extends into the second nozzle 129. Flow of the liquid refrigerant is throttled in the ejector by the control valve assembly.

The method includes the steps of accelerating the refrigerant mixture through the mixing chamber to a velocity greater than that which sound travels in the refrigerant mixture; and creating a pressure shock in the mixing chamber thereby causing pressure of the refrigerant mixture to increase above the first pressure and the second pressure.

The method also includes the steps of providing a diffuser coupled to a terminal end of the second conduit; and condensing at least a portion of the vapor refrigerant in the diffuser thereby causing pressure of the refrigerant mixture to increase above the first pressure and the second pressure.

The method further includes the steps of accelerating the refrigerant mixture through the mixing chamber to a velocity greater than that which sound travels in the refrigerant mixture; and creating a pressure shock in the diffuser thereby causing pressure of the refrigerant mixture to increase above the first pressure and the second pressure.

During operation of the ejector 6, compressed vapor refrigerant is provided from the compressor 4 to the first nozzle 30. A liquid refrigerant is flowed through in the first conduit 28. The liquid refrigerant is discharged into the mixing chamber 34 with the vapor refrigerant resulting in a two phase mixture of refrigerant. The mixing of the vapor and liquid refrigerant, leads to the condensation of the vapor refrigerant thus pressurizing the two phase refrigerant mixture to a pressure greater than that of the vapor and liquid refrigerant supplied to the ejector 6.

The refrigeration cycle of the present invention has a higher coefficient of performance than the prior art refrigeration cycle 60 because the combined energy required to operate the compressor and the pump of the present invention is less that the energy required to operate the compressor of the prior art. In particular, the theoretical coefficient of performance of the refrigeration cycle of the present invention using R22 refrigerant is estimated to be approximately 4.9 wherein the theoretical coefficient of performance of the prior art refrigeration cycle is estimated to be approximately 3.5.

Although the present invention has been disclosed and described with reference to certain embodiments thereof, it should be noted that other variations and modifications may be made, and it is intended that the following claims cover the variations and modifications within the true scope of the invention.

What is claimed is:

1. A refrigerant pressurization system comprising:

an ejector having a first conduit for flowing a liquid refrigerant therethrough and a first nozzle for flowing a vapor refrigerant and accelerating at least a refrigerant mixture therethrough and a second nozzle extending from said first conduit, said first conduit positioned such that the liquid refrigerant is discharged from said first conduit into said first nozzle;

said ejector including a mixing chamber for condensing the vapor refrigerant; said mixing chamber comprising at least a portion of said first nozzle and transitioning into a second conduit having a substantially constant cross sectional area;

said ejector including means for controlling the flow of the liquid refrigerant;

wherein at least a portion of said means for controlling the flow of liquid refrigerant extends into said second nozzle; and wherein the refrigerant mixture in at least a portion of said second conduit is at a pressure greater than that of the liquid refrigerant entering said first conduit and greater than that of the vapor refrigerant entering said first nozzle.

2. The refrigerant pressurization system of claim 1 further comprising:

a pump in fluid communication with said first conduit for increasing the pressure of the liquid refrigerant supplied thereto.

3. The refrigerant pressurization system of claim 2 further comprising:

a separator in fluid communication with a suction port of said pump for supplying the liquid refrigerant thereto.

4. The refrigerant pressurization system of claim 1 wherein said ejector includes a diffuser coupled to a terminal end of said second conduit for discharging the refrigerant mixture therefrom.

5. The refrigerant pressurization system of claim 4 wherein the refrigerant mixture in at least one of said at least a portion of said second conduit and at least a portion of said diffuser is at a pressure greater than that of the liquid refrigerant entering said first conduit and greater than that of the vapor refrigerant entering said first nozzle.

6. The refrigerant pressurization system of claim 3 further comprising:

a compressor having a discharge and a compressor suction;

said discharge being in fluid communication with said first nozzle;

a first heat exchanger disposed between and in fluid communication with said diffuser and said separator;

means for decompressing the liquid refrigerant in fluid communication with said separator;

a second heat exchanger disposed between and in fluid communication with said means for decompressing said liquid refrigerant and said compressor suction.

7. A method of operating a refrigerant pressurization system comprising the steps of:

providing a vapor refrigerant; a liquid refrigerant; a compressor having a discharge; an ejector having a first conduit and a first nozzle; said first conduit being in fluid communication with said discharge, said first conduit positioned such that the liquid refrigerant is discharged into said first nozzle; said ejector including a mixing chamber comprising at least a portion of said first nozzle and transitioning into a second conduit having a substantially constant cross sectional area; and a pump in fluid communication with the liquid refrigerant and said first conduit;

pressurizing the liquid refrigerant with said pump to a first pressure;

flowing the liquid refrigerant through said first conduit;

compressing the vapor refrigerant with said compressor to a second pressure;

supplying vapor refrigerant to said first nozzle;

ejecting the liquid refrigerant from said first conduit into a stream of vapor refrigerant flowing though said first nozzle and into said mixing chamber thereby defining a refrigerant mixture;

flowing the refrigerant mixture through said first nozzle and into said second conduit; and condensing at least a portion of the vapor refrigerant in said mixing chamber thereby causing pressure of the refrigerant mixture to increase above the first pressure and the second pressure.

8. The method of claim 7 further including the steps of:

providing means for controlling the flow of liquid refrigerant coupled to said ejector and a second nozzle extending from said first conduit; and wherein at least a portion of said means for controlling the flow of liquid refrigerant extends into said second nozzle; and throttling flow of the liquid refrigerant in said ejector by said means for controlling the flow of liquid refrigerant.

9. The method of claim 7 further including the steps of:

accelerating the refrigerant mixture through said mixing chamber to a velocity greater than that which sound travels in the refrigerant mixture; and creating a pressure shock in said mixing chamber thereby causing pressure of the refrigerant mixture to increase above the first pressure and the second pressure.

10. The method of claim 7 further including the steps of:

providing a diffuser coupled to a terminal end of said second conduit; and condensing at least a portion of the vapor refrigerant in the diffuser thereby causing pressure of the refrigerant mixture to increase above the first pressure and the second pressure.

11. The method of claim 10 further including the steps of:

accelerating the refrigerant mixture through said mixing chamber to a velocity greater than that which sound travels in the refrigerant mixture; and creating a pressure shock in said diffuser thereby causing pressure of the refrigerant mixture to increase above the first pressure and the second pressure.

* * * * *